US009790961B2

(12) United States Patent
Wu et al.

(10) Patent No.: US 9,790,961 B2
(45) Date of Patent: Oct. 17, 2017

(54) BLOWER AND METHOD FOR DECREASING EDDY NOISE

(71) Applicants: Shang-Hsuang Wu, Hsin-Chu (TW); Jhih-Hao Chen, Hsin-Chu (TW)

(72) Inventors: Shang-Hsuang Wu, Hsin-Chu (TW); Jhih-Hao Chen, Hsin-Chu (TW)

(73) Assignee: CORETRONIC CORPORATION, Hsin-Chu (TW)

( * ) Notice: Subject to any disclaimer, the term of this patent is extended or adjusted under 35 U.S.C. 154(b) by 229 days.

(21) Appl. No.: 14/566,727

(22) Filed: Dec. 11, 2014

(65) Prior Publication Data

US 2015/0292521 A1 Oct. 15, 2015

(30) Foreign Application Priority Data

Apr. 11, 2014 (CN) ..... 2014 1 0145311

(51) Int. Cl.
*F04D 29/66* (2006.01)
*F04D 29/28* (2006.01)
(Continued)

(52) U.S. Cl.
CPC ..... *F04D 29/665* (2013.01); *F04D 17/16* (2013.01); *F04D 25/08* (2013.01); *F04D 29/282* (2013.01);
(Continued)

(58) Field of Classification Search
CPC ..... G10K 11/16; G10K 11/178; G10K 2210/1282; G10K 2210/3028
(Continued)

(56) References Cited

U.S. PATENT DOCUMENTS 5,293,578 A * 3/1994 Nagami ..... H03G 9/025 381/71.14
5,515,444 A * 5/1996 Burdisso ..... G10K 11/1788 381/190
(Continued)

FOREIGN PATENT DOCUMENTS

CN 101668954 3/2010
CN 202560660 11/2012
(Continued)

OTHER PUBLICATIONS

"Office Action of Europe Counterpart Application", dated Aug. 31, 2015, p. 1-p. 7.
(Continued)

*Primary Examiner* — Mohammad Islam
(74) *Attorney, Agent, or Firm* — Jianq Chyun IP Office

(57) ABSTRACT

A blower and a method for decreasing eddy noise are provided. The blower includes a fan frame, a fan wheel, at least one induction element and a coil. The fan frame has in inlet and an outlet. The fan wheel is disposed in the fan frame and has a wheel hub and a plurality of fan blades connected to periphery of the wheel hub. The induction elements are fixed to the corresponding fan blades, the coil is disposed on the fan frame for driving the at least one induction element, such that the fan blade corresponding to the induction element swing back and forth to generate a vibration sound, and the vibration sound is counteracted with eddy noise generated when the fan wheel rotates. Moreover, the method for decreasing eddy noise is also provided.

23 Claims, 6 Drawing Sheets

(51) Int. Cl.

| | |
|---|---|
| ***F04D 29/30*** | (2006.01) |
| ***F04D 29/42*** | (2006.01) |
| ***F04D 17/16*** | (2006.01) |
| ***F04D 25/08*** | (2006.01) |

(52) U.S. Cl.
CPC ..... *F04D 29/305* (2013.01); *F04D 29/422* (2013.01); *F04D 29/666* (2013.01); *F05D 2260/962* (2013.01); *F05D 2270/333* (2013.01); *F05D 2270/44* (2013.01); *F05D 2270/62* (2013.01)

(58) Field of Classification Search
USPC ..... 381/71.1–71.14, 73.1, 98
See application file for complete search history.

(56) References Cited

U.S. PATENT DOCUMENTS

| | | | | |
|---|---|---|---|---|
| 5,636,287 | A | 6/1997 | Kubli et al. | |
| 6,327,368 | B1 * | 12/2001 | Yamaguchi | G10K 11/1788 181/224 |
| 6,600,399 | B1 * | 7/2003 | Trandafir | H01F 7/066 335/222 |
| 6,973,193 | B1 * | 12/2005 | Tse | B64D 33/06 181/204 |
| 2007/0223714 | A1 * | 9/2007 | Nishikawa | G10K 11/1788 381/71.1 |
| 2008/0187147 | A1 * | 8/2008 | Berner | F24F 13/24 381/71.3 |
| 2009/0180637 | A1 | 7/2009 | Su et al. | |
| 2010/0028134 | A1 * | 2/2010 | Slapak | F24F 13/24 415/119 |
| 2011/0070109 | A1 | 3/2011 | Kanai et al. | |
| 2013/0189130 | A1 | 7/2013 | Chang et al. | |
| 2013/0259249 | A1 * | 10/2013 | Sakamoto | G10K 11/175 381/71.4 |
| 2014/0003624 | A1 * | 1/2014 | Stromback | H04R 23/00 381/98 |
| 2015/0269924 | A1 * | 9/2015 | Yano | G10K 11/178 381/71.1 |
| 2016/0225366 | A1 * | 8/2016 | Maeda | G10K 11/1784 |

FOREIGN PATENT DOCUMENTS

| | | |
|---|---|---|
| CN | 202673791 | 1/2013 |
| EP | 0715131 | 6/1996 |
| WO | 9302445 | 2/1993 |

OTHER PUBLICATIONS

"Office Action of China Counterpart Application", dated Oct. 31, 2016, p. 1-p. 7.

* cited by examiner

BLOWER AND METHOD FOR DECREASING EDDY NOISE

CROSS-REFERENCE TO RELATED APPLICATION

This application claims the priority benefit of China application serial no. 201410145311.7, filed on Apr. 11, 2014. The entirety of the above-mentioned patent application is hereby incorporated by reference herein and made a part of this specification.

BACKGROUND

Technical Field

The invention relates to a blower and a method for decreasing eddy noise.

Related Art

Regarding current heat dissipation devices used in collaboration with electronic components, besides commonly used passive heat dissipation devices (for example, a heat sink, etc.), fans that produce airflow to achieve a forced cooling effect are also as commonly used heat dissipation devices. Along with product development and improvement of living standards, users have increasing demand on low-noise products, and the airflow noise generated when the fan is used to provide the forced cooling effect becomes one of the noises concerned by the user. Due to a flow field characteristic of a blower, a usage rate of the blower in thin type electronic products is gradually increased. Since a fan wheel in a fan frame of the blower is a rotation member, and a rotation speed of the fan wheel is relatively high, a wind noise is generated when a fan blade is rotated at a high speed to collide with air, which usually bothers the user. Fan-related patents include U.S. Patent publication No. 20110070109, U.S. Patent publication No. 20130189130 and U.S. Patent publication No. 20140003624 and China utility model patent No. 202560660.

SUMMARY

The invention is directed to a blower, which has function of decreasing eddy noise.

The invention is directed to a method for decreasing eddy noise, which is adapted to decrease the eddy noise generated when a blower operates.

An embodiment of the invention provides a blower including a fan frame, a fan wheel, at least one induction element and a coil. The fan frame has in inlet and an outlet. The fan wheel is disposed in the fan frame and has a wheel hub and a plurality of fan blades connected to periphery of the wheel hub. The induction elements are disposed in the fan blades, the coil is disposed on the fan frame for driving the induction elements, such that the fan blades corresponding to the induction elements swing back and forth to generate a vibration sound.

In an embodiment of the invention, the vibration sound generated by the fan blades has a same frequency and amplitude with that of an eddy noise, and the vibration sound generated by the fan blades has an opposite phase with that of the eddy noise.

In an embodiment of the invention, the fan frame has a throat portion, and a space between the fan wheel and the fan frame is defined as a pressure zone and a pressure releasing zone, and a generation position of the eddy noise is near the throat portion.

In an embodiment of the invention, the induction elements are permanent magnets.

In an embodiment of the invention, the blower further includes a control circuit, the control circuit is electrically connected to the coil and supplies a current to the coil, and the coil generates a magnetic field to drive the induction elements, so as to drive the corresponding fan blades to swing back and forth to generate the vibration sound.

In an embodiment of the invention, the induction elements are piezoelectric materials.

In an embodiment of the invention, the control circuit controls a frequency, an intensity and a phase of the current supplied to the coil, so as to correspondingly change a frequency, an amplitude and a phase of the vibration sound.

In an embodiment of the invention, the blower further includes a microphone electrically connected to the control circuit for detecting a frequency, an amplitude and a phase of the eddy noise.

In an embodiment of the invention, the coil surrounds the inlet.

In an embodiment of the invention, the coil is located near the throat portion.

In an embodiment of the invention, the coil surrounds the fan frame and is located between the outlet and the fan wheel.

In an embodiment of the invention, the induction elements are embedded in the corresponding fan blades.

In an embodiment of the invention, the blower further includes a motor, the fan wheel is located between the fan frame and the motor, and the fan wheel rotates relative to the fan frame.

Another embodiment of the invention provides a method for decreasing eddy noise, which is adapted to a blower. The blower includes a fan frame and a fan wheel disposed in the fan frame. The method for decreasing eddy noise includes following steps. First, a frequency, an amplitude and a phase of eddy noise generated when the fan wheel rotates are obtained. Then, at least one fan blade of the fan wheel of the blower is swung back and forth to generate a vibration sound according to the frequency, the amplitude and the phase of the eddy noise, where the vibration sound has a same frequency and amplitude with that of the eddy noise, and the vibration sound has an opposite phase with that of the eddy noise, such that the vibration sound and the eddy noise generated when the fan wheel rotates are counteracted to each other.

In an embodiment of the invention, the step of obtaining the frequency, the amplitude and the phase of the eddy noise includes reading data from a database, where the data is the frequency, the amplitude and the phase of the eddy noise corresponding to a current rotation speed of the fan wheel.

In an embodiment of the invention, the step of obtaining the frequency, the amplitude and the phase of the eddy noise includes detecting the frequency, the amplitude and the phase of the eddy noise through a microphone.

In an embodiment of the invention, the microphone is disposed near a throat portion of the fan frame.

In an embodiment of the invention, the step of swinging the at least one fan blade of the fan wheel of the blower back and forth to generate the vibration sound includes using a control circuit to supply a current to a coil of the fan frame to generate a magnetic field to drive at least one induction element fixed to the fan blades according to the frequency, the amplitude and the phase of the eddy noise, so as to drive the fan blade to swing back and forth to generate the vibration sound.

In an embodiment of the invention, the control circuit controls a frequency, an intensity and a phase of the current supplied to the coil, so as to correspondingly change a frequency, an amplitude and a phase of the vibration sound.

In an embodiment of the invention, the step of obtaining the frequency, the amplitude and the phase of the eddy noise includes detecting the frequency, the amplitude and the phase of the eddy noise through a microphone, where the microphone is electrically connected to the control circuit, and the control circuit supplies the current to the coil according to a detection result of the microphone.

According to the above descriptions, in the embodiment of the invention, a magnetic force (for example, the induction elements fixed to the fan blades and the coil supplied with electricity) is used to swing the fan blades of the fan wheel of the blower to generate the vibration sound, so as to counteract the eddy noise generated when the fan wheel rotates.

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
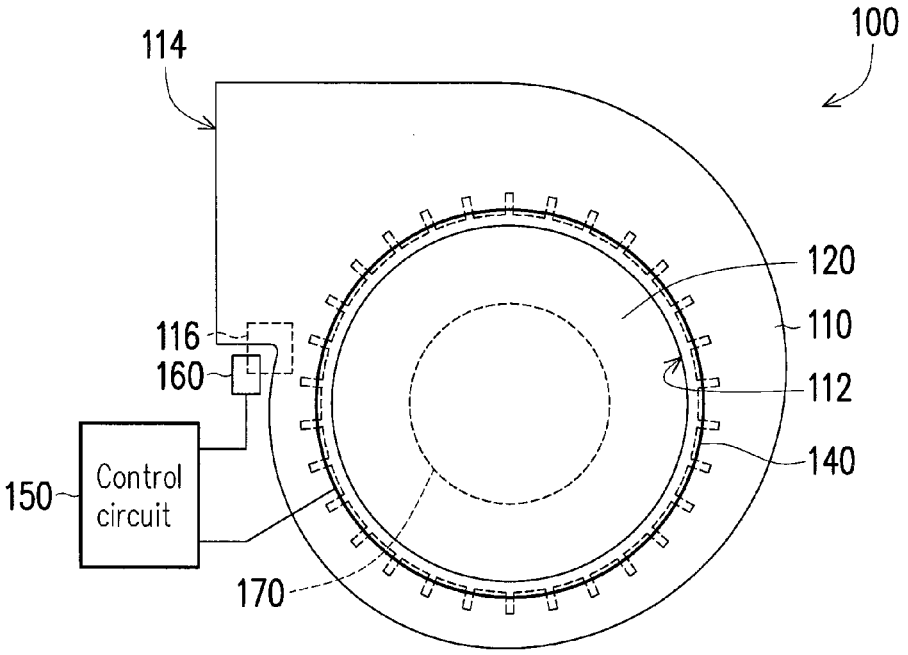
FIG. 1 is a front view of a blower according to an embodiment of the invention.
Figure 2:
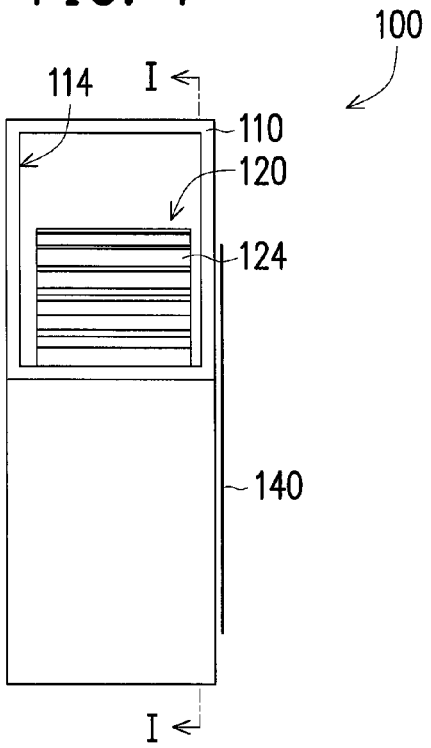
FIG. 2 is a left side view of the blower of FIG. 1.
Figure 3:
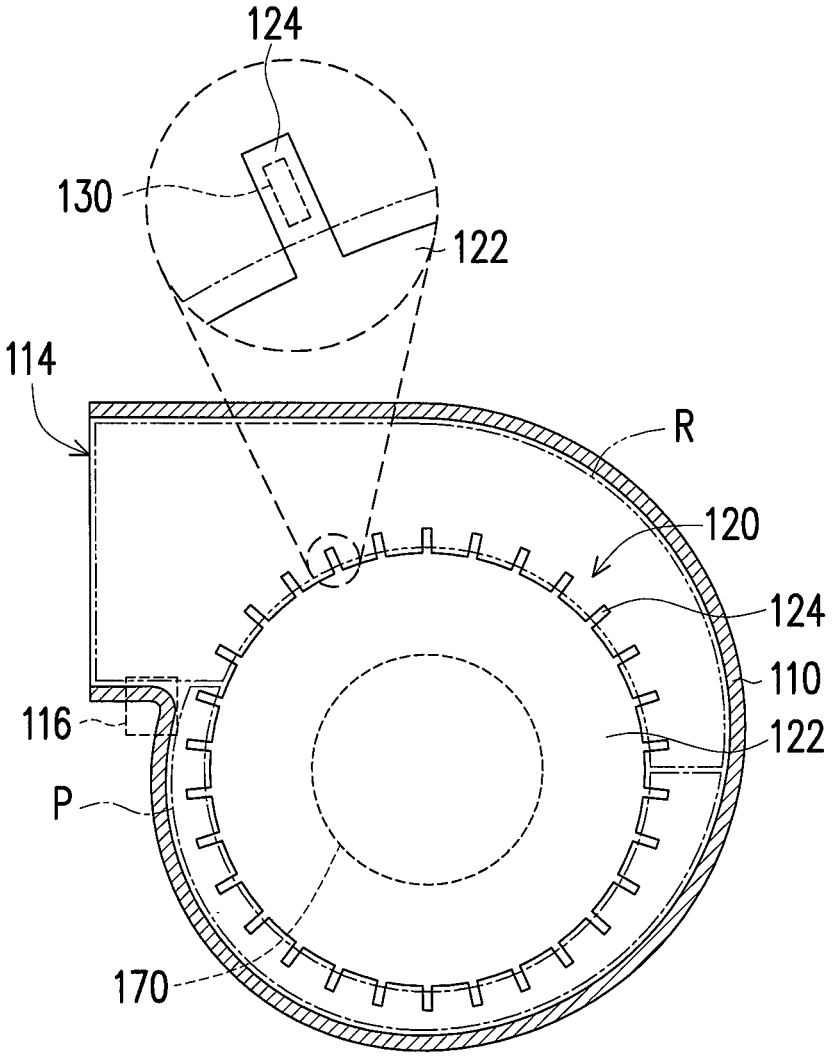
FIG. 3 is a cross-sectional view of the blower of FIG. 2 along line I-I.

Referring to FIG. 1, FIG. 2 and FIG. 3, a blower 100 of the embodiment includes a fan frame 110 and a fan wheel 120 disposed in the fan frame 110. The fan frame 110 has an inlet 112 and an outlet 114. The fan wheel 120 has a wheel hub 122 and a plurality of fan blades 124 (or referred to as fins) connected to periphery of the wheel hub 122. When the fan wheel 120 rotates, an airflow can be inlet into the fan frame 110 from the inlet 112, and the airflow is compressed and exhausted from the fan frame 110 through the outlet 114.

In the embodiment, the fan frame 110 has a throat portion 116, and a space between the fan wheel 120 and the fan frame 110 is defined as a pressure zone P and a pressure releasing zone R. As shown in FIG. 3, after the airflow is inlet through the inlet 112 (the air flowing direction is perpendicular to paper's surface), the airflow passes through the pressure zone P along the periphery of the fan wheel 120 from the throat portion 116, and passes through the pressure releasing zone R to reach the outlet 114. Namely, the airflow passes through the pressure zone P and then passes through the pressure releasing zone R to reach the outlet 114. Therefore, when the fan wheel 120 rotates, the airflow is compressed at the pressure zone P, and is transmitted to the pressure releasing zone R, and then the airflow is exhausted from the fan frame 110 through the outlet 114. It should be noticed that an eddy generated when the fan wheel 120 rotates generally produces noise (i.e. eddy noise) near the throat portion 116, so that a generation position (or a source) of the eddy noise is generally near the throat portion 116.

In order to decrease the eddy noise, as shown in FIG. 1 and FIG. 3, for example, the blower 100 further includes a plurality of induction elements 130 and a coil 140. Each of the induction elements 130 is disposed in the fan blade 124. The coil 140 is disposed at an outer side of the fan frame 110, and is supplied with a current to generate a magnetic field to drive the induction elements 130, and the induction elements 130 are driven by the magnetic field and drive the fan blades 124 to swing back and forth to generate a vibration sound. In this way, the vibration sound generated by the fan blades 124 can counteract with the eddy noise. In order to counteract the eddy noise, the vibration sound may have a same frequency and amplitude with that of the eddy noise, and the vibration sound has an opposite phase with that of the eddy noise.

In the embodiment, as shown in FIG. 3, each of the fan blades 124 can be configured with the induction element 130. However, in other embodiments, the fan blades 124 can be alternately configured with the induction elements 130 according to an actual requirement. For example, the first fan blade, the third fan blade, the fifth fan blade, etc. are respectively configured with the induction element 130 in sequence. For another embodiment, the first fan blade, the fourth fan blade, the seventh fan blade, etc. are respectively configured with the induction element 130 in sequence.

In the embodiment, as shown in FIG. 3, the induction element 130 can be embedded inside the fan blade 124. For example, when the fan blades 124 are fabricated through molding, the fan blades 124 can wrap the induction elements 130. In another embodiment that is not shown, as long as the fan blade 124 can be swung back and forth under the function of a magnetic field, the induction element 130 can be fixed to any position on the fan blade 124.

Figure 4A:
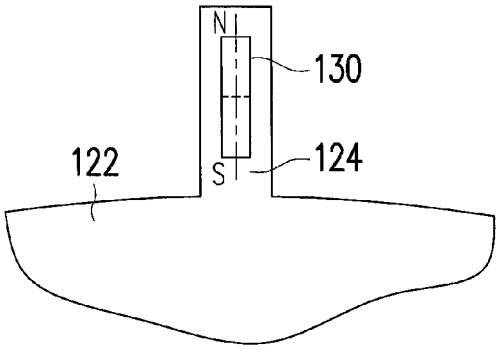
FIG. 4A to FIG. 4C respectively illustrate three position relationships between a fan blade and an induction element of FIG. 3.
Figure 4B:
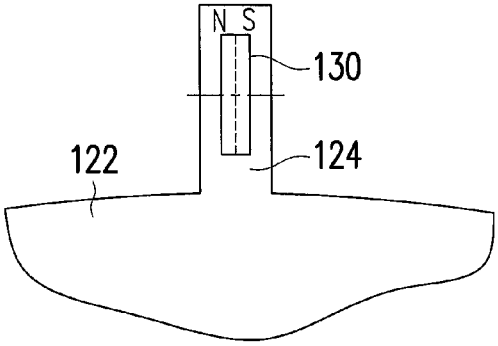
Figure 4C:
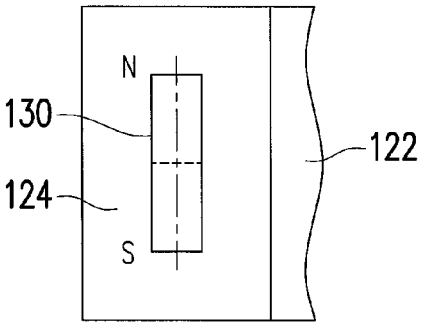

In the embodiment, as shown in FIG. 4A, the induction element 130 is, for example, a permanent magnet, and a placing direction of magnetic poles (i.e. direction of an N-pole and an S-pole) of the induction element 130 can be adjusted according to a direction of the magnetic field generated by the coil 140. Moreover, compared to the fan blade 124, as shown in FIG. 4A, the placing direction of the magnetic poles of the induction element 130 can be parallel to an extending direction of the fan blade 124 (i.e. a direction extending away from the wheel hub 122). As shown in FIG. 4B, the placing direction of the magnetic poles of the induction element 130 can be perpendicular to the extending direction of the fan blade 124. As shown in FIG. 4C, the placing direction of the magnetic poles of the induction element 130 is tangential to a rotation direction of the fan wheel 120 or parallel to a width direction of the fan blade 124.

In the embodiment, as shown in FIG. 1 and FIG. 3, the blower 100 may further include a control circuit 150. The control circuit 150 is electrically connected to the coil 140 and supplies a current to the coil 140, and the coil 140 generates a magnetic field to drive the induction elements 130. Due to the induction of the magnetic field, the induction elements 130 drive the fan blades 120 to swing back and forth to generate the vibration sound. In detail, the control circuit 150 supplies the current to the coil 140, and the coil 140 generates the magnetic field. The effect of the magnetic field generated by the coil 140, the fan blades 120 swing back and forth to generate the vibration sound. Therefore, the control circuit 150 can be used to control a frequency, an intensity and a phase of the current supplied to the coil 140, so as to correspondingly change a frequency, an amplitude and a phase of the vibration sound generated by the fan blades 124.

In an embodiment, as shown in FIG. 1 and FIG. 3, the blower 100 may further include a microphone 160. The microphone 160 is electrically connected to the control circuit 150 for detecting a frequency, an amplitude and a phase of the eddy noise. Therefore, the control circuit 150 can control the frequency, the intensity and the phase of the current supplied to the coil 140 according to the frequency, the amplitude and the phase of the eddy noise detected by the microphone 160, so as to correspondingly change the frequency, the amplitude and the phase of the vibration sound generated by the fan blades 124, and achieve an effect of decreasing the eddy noise in real-time.

In an embodiment, as shown in FIG. 1 and FIG. 3, the blower 100 may further include a motor 170. The fan wheel 120 is located between the motor 170 and the fan frame 110, and the fan wheel 120 can rotate relative to the fan frame 110. The motor 170 can be electrically connected to the control circuit 150, and the control circuit 150 can be used to control a rotation speed of the fan wheel 120.

In the embodiment, as shown in FIG. 1 and FIG. 3, the coil 140 of the blower 100 surrounds the inlet 112 of the fan frame 110, and all of the induction elements 130 can be influenced by the magnetic field generated by the coil 140 to generate the vibration sound, so as to counteract the eddy noise.

Figure 5:
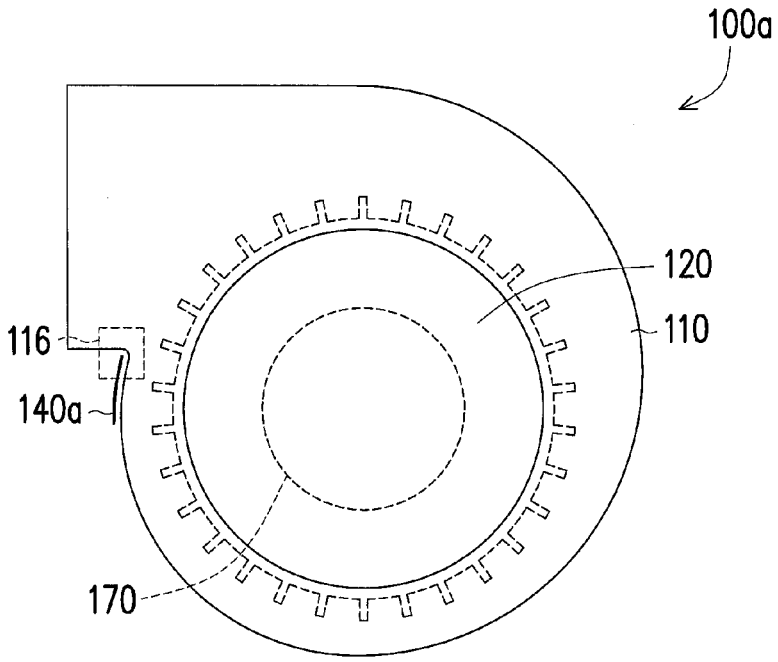
FIG. 5 is a front view of a blower according to another embodiment of the invention.
Figure 6:
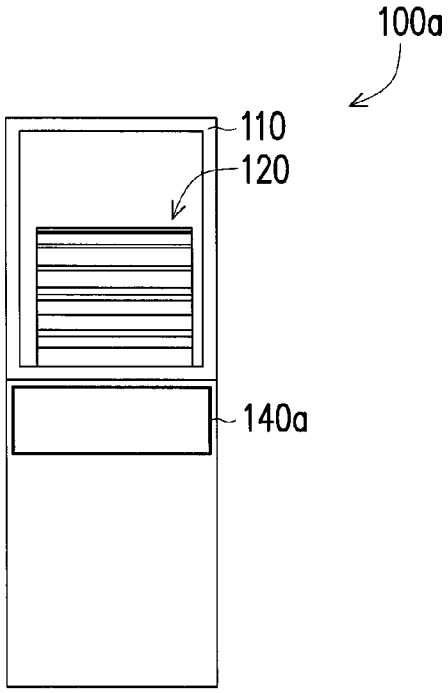
FIG. 6 is left side view of the blower of FIG. 5.

In another embodiment, as shown in FIG. 5 and FIG. 6, different to the blower 100 of the embodiment of FIG. 1 and FIG. 3, the coil 140*a* of the blower 100*a* is located near the throat portion 116, such that the only the induction elements (for example, the induction elements 130 shown in FIG. 3) of the fan blades 124 that are close to the coil 140*a* are influenced by the magnetic field generated by the coil 140*a* to generate the vibration sound, so as to counteract the eddy noise, and meanwhile decrease a waterbed effect of a sound field generated at other places.

Figure 7:
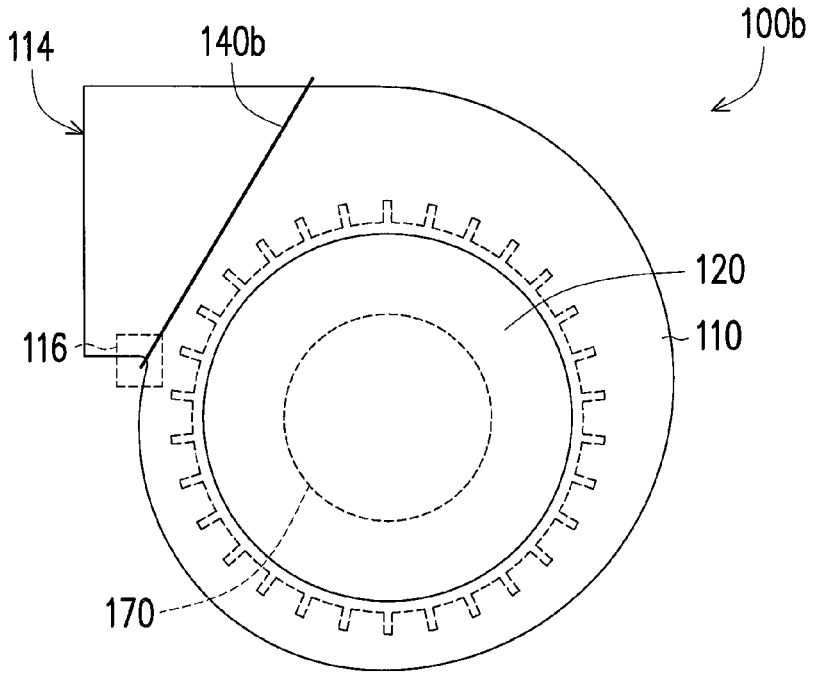
FIG. 7 is a front view of a blower according to another embodiment of the invention.
Figure 8:
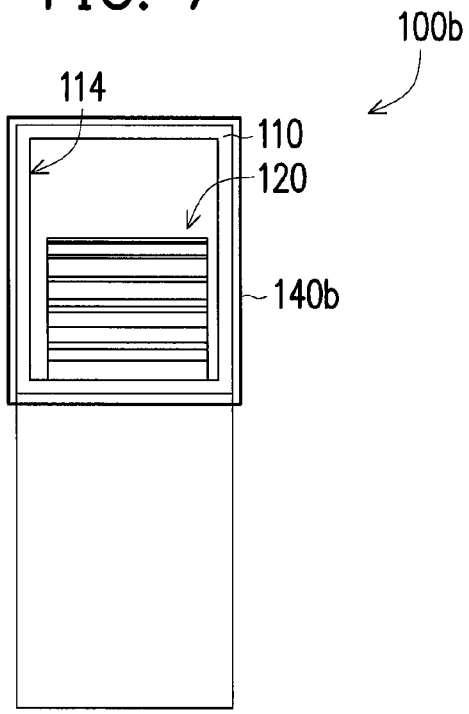
FIG. 8 is a left side view of the blower of FIG. 7.

In another embodiment, as shown in FIG. 7 and FIG. 8, different to the blower 100 of the embodiment of FIG. 1 and FIG. 3, the coil 140*b* of the blower 100*b* surrounds the fan frame 110 and is located between the outlet 114 and the fan wheel 120. In detail, the coil 140*b* is locate between the throat portion 116 and the outer fan frame 110 and is close to the outlet 114, such that only when the induction elements (for example, the induction elements 130 of FIG. 3) are rotated to be close to the coil 140*b*, the induction elements are influenced by the magnetic field generated by the coil 140*b* to generate the vibration sound, so as to counteract the eddy noise, and meanwhile decrease the waterbed effect of the sound field generated at other places.

In another embodiment, the induction element can be a piezoelectric material, and when the coil is supplied with electricity to generate the magnetic field, the magnetic field induces the induction coil on the piezoelectric material to generate a current, and the piezoelectric material swings back and forth due to the current, and drives the fan blade to swing to generate vibration sound.

In the aforementioned embodiments, the blower having a function of decreasing eddy noise is introduced. In the following embodiment, a method for decreasing eddy noise adapted to the blower is introduced below. It should be noticed that in the aforementioned embodiments of the blower, the method for decreasing eddy noise is also introduced. Therefore, the following embodiment related to the method for decreasing eddy noise can serve as a supplementary description of the aforementioned embodiments of the blower without limiting the aforementioned embodiments.

Figure 9:
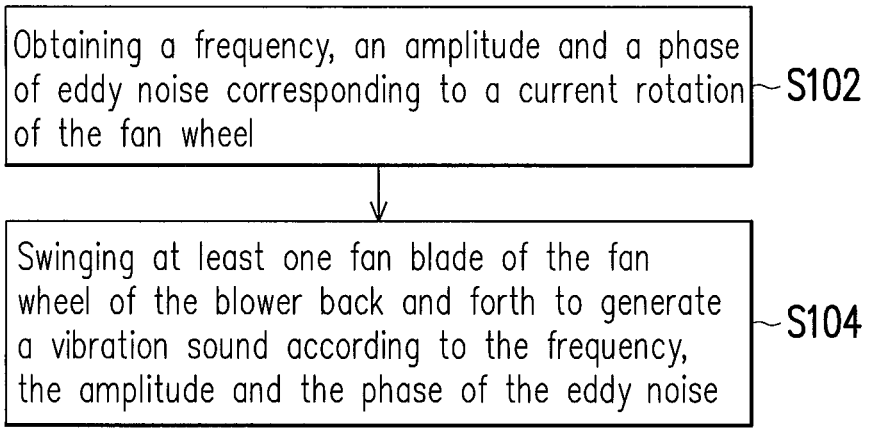
FIG. 9 is a flowchart illustrating a method for decreasing eddy noise according to an embodiment of the invention.

Referring to FIG. 9, in the embodiment, the blower 100 of FIG. 1 to FIG. 3 is taken as an example for description. In step S102, a frequency, an amplitude and a phase of eddy noise corresponding to a current rotation of the fan wheel 120 are obtained. Then, in step S104, at least one fan blade 124 of the fan wheel 120 of the blower 100 is swung back and forth to generate a vibration sound according to the frequency, the amplitude and the phase of the eddy noise. The vibration sound has a same frequency and amplitude with that of the eddy noise, and the vibration sound has an opposite phase with that of the eddy noise, such that the vibration sound and the eddy noise generated when the fan wheel rotates are counteracted to each other.

In the embodiment, the step (S102) of obtaining the frequency, the amplitude and the phase of the eddy noise includes accessing a data from a database. For example, the frequencies, amplitudes and phases of the eddy noise generated under different rotation speeds of the fan wheel 120 can be concluded through data simulation or actual experiments, etc., and the concluded data is stored in the database. Therefore, a batch of data can be obtained from the database according to a current rotation speed of the fan wheel 120, where the obtained data is the frequency, the amplitude and the phase of the eddy noise corresponding to the current rotation speed of the fan wheel 120.

In the embodiment, the step (S102) of obtaining the frequency, the amplitude and the phase of the eddy noise further includes detecting the frequency, the amplitude and the phase of the eddy noise through the microphone 160. As shown in FIG. 1, the microphone 160 can be disposed near the throat portion 116 of the fan frame 100 to obtain the frequency, the amplitude and the phase of the eddy noise near the throat portion 116. By directly detecting the frequency, the amplitude and the phase of the currently generated eddy noise, and accordingly adjusting the generated vibration sound, the effect of decreasing the eddy noise is improved.

In the embodiment, the step (S104) of swinging the at least one fan blade 124 of the fan wheel 120 of the blower 100 back and forth to generate the vibration sound includes supplying a current to the coil 140 of the fan frame 110 to generate a magnetic field to drive the induction elements 130 fixed to the fan blades 124 according to the frequency, the amplitude and the phase of the eddy noise through the control circuit 150, so as to drive the fan blades 124 to swing back and forth to generate the vibration sound. The control circuit 150 can control a frequency, an intensity and a phase of the current supplied to the coil 140, so as to correspondingly change a frequency, an amplitude and a phase of the vibration sound. In case that the microphone 160 is used to detect the frequency, the amplitude and the phase of the eddy noise, the control circuit 150 electrically connected to the microphone 160 can supply the current to the coil 140 according to a detection result of the microphone 160.

In summary, in the embodiments of the invention, a magnetic force (for example, the induction elements fixed to the fan blades and the coil supplied with electricity) is used to swing the fan blades of the fan wheel of the blower to generate the vibration sound, so as to counteract the eddy noise generated when the fan wheel rotates. The vibration sound and the eddy noise may have the same frequency and amplitude and have opposite phases, such that the vibration sound and the eddy noise can be counteracted to each other, so as to improve the effect of decreasing the eddy noise. The vibration sound can be generated according to basic parameters (for example, frequency, amplitude and phase) of the eddy noise corresponding to the rotation speed of the fan wheel, or according to basic parameters of the eddy noise detected by the microphone, so as to decrease the eddy noise in real-time.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the present disclosure is intended to be dedicated to the public regardless of whether the element or component is explicitly recited in the following claims.

What is claimed is:

1. A blower, comprising:

a fan frame, having an inlet and an outlet;

a fan wheel, disposed in the fan frame, and having a wheel hub;

a plurality of fan blades connected to a periphery of the wheel hub;

at least one induction element, disposed with the fan blades; and a coil, disposed on the fan frame, adapted to drive the induction elements, such that the fan blades corresponding to the induction elements swing back and forth to generate a vibration sound, wherein a current is supplied to the coil of the fan frame to generate a magnetic field to drive at least one induction element fixed to the fan blades according to a frequency, an amplitude and a phase of an eddy noise through a control circuit, so as to drive the fan blade to swing back and forth to generate the vibration sound.

2. The blower as claimed in claim 1, wherein the fan frame has a throat portion, and a space between the fan wheel and the fan frame is defined as a pressure zone and a pressure releasing zone, and a generation position of the eddy noise is near the throat portion.

3. The blower as claimed in claim 1, wherein the induction elements are permanent magnets.

4. The blower as claimed in claim 3, further comprising:

a control circuit, electrically connected to the coil, and supplying a current to the coil, such that the coil generates a magnetic field to drive the induction elements, so as to drive the corresponding fan blades to swing back and forth to generate the vibration sound.

5. The blower as claimed in claim 1, wherein the induction elements are piezoelectric materials.

6. The blower as claimed in claim 4, wherein the control circuit is adapted to control a frequency, an intensity and a phase of the current supplied to the coil, so as to correspondingly change a frequency, an amplitude and a phase of the vibration sound.

7. The blower as claimed in claim 4, further comprising:
a microphone, electrically connected to the control circuit, and configured to detect a frequency, an amplitude and a phase of the eddy noise.

8. The blower as claimed in claim 1, wherein the coil surrounds the inlet.

9. The blower as claimed in claim 1, wherein the coil is located near the throat portion.

10. The blower as claimed in claim 1, wherein the coil surrounds the fan frame and is located between the outlet and the fan wheel.

11. The blower as claimed in claim 1, wherein the induction elements are embedded in the corresponding fan blades.

12. The blower as claimed in claim 1, further comprising:
a motor, wherein the fan wheel is located between the fan frame and the motor, and the fan wheel rotates relative to the fan frame.

13. A method for decreasing eddy noise, adapted to a blower, wherein the blower comprises a fan frame and a fan wheel disposed in the fan frame, and the method for decreasing eddy noise comprising:
obtaining a frequency, an amplitude and a phase of eddy noise corresponding to a current rotation of the fan wheel; and
swinging at least one fan blade of the fan wheel of the blower back and forth to generate a vibration sound according to the frequency, the amplitude and the phase of the eddy noise, wherein the vibration sound has the same frequency as the eddy noise and the same amplitude as the eddy noise, and the vibration sound has an opposite phase of the eddy noise, such that the vibration sound and the eddy noise are counteracted to each other,
wherein the step of swinging the at least one fan blade of the fan wheel of the blower back and forth to generate the vibration sound further comprises:
supplying a current to a coil of the fan frame to generate a magnetic field to drive at least one induction element fixed to the fan blades according to the frequency, the amplitude and the phase of the eddy noise through a control circuit, so as to drive the fan blade to swing back and forth to generate the vibration sound.

14. The method for decreasing eddy noise as claimed in claim 13, wherein the step of obtaining the frequency, the amplitude and the phase of the eddy noise comprises:
accessing a data from a database, wherein the data is the frequency, the amplitude and the phase of the eddy noise corresponding to a current rotation speed of the fan wheel.

15. The method for decreasing eddy noise as claimed in claim 13, wherein the step of obtaining the frequency, the amplitude and the phase of the eddy noise comprises:
detecting the frequency, the amplitude and the phase of the eddy noise through a microphone.

16. The method for decreasing eddy noise as claimed in claim 15, wherein the microphone is disposed near a throat portion of the fan frame.

17. The method for decreasing eddy noise as claimed in claim 13, wherein the control circuit controls a frequency, an intensity and a phase of the current supplied to the coil, so as to correspondingly change a frequency, an amplitude and a phase of the vibration sound.

18. The method for decreasing eddy noise as claimed in claim 13, wherein the step of obtaining the frequency, the amplitude and the phase of the eddy noise comprises:
detecting the frequency, the amplitude and the phase of the eddy noise through a microphone, wherein the microphone is electrically connected to the control circuit, and the control circuit supplies the current to the coil according to a detection result of the microphone.

19. The blower as claimed in claim 1, wherein the induction elements are fixed to the corresponding fan blades.

20. The blower as claimed in claim 1, wherein the fan blade is formed with the induction element.

21. A blower, comprising:
a fan frame, having an inlet and an outlet;
a fan wheel, disposed in the fan frame, and having a wheel hub and a plurality of fan blades connected to a periphery of the wheel hub;
at least one induction element, wherein the induction elements are fixed to the corresponding fan blades; and
a coil, disposed on the fan frame, configured to drive the induction elements, such that the fan blades corresponding to the induction elements swing back and forth to generate a vibration sound.

22. A blower, comprising:
a fan frame, having an inlet and an outlet;
a fan wheel, disposed in the fan frame, and having a wheel hub and a plurality of fan blades connected to a periphery of the wheel hub;
at least one induction element, wherein the fan blades are formed with the induction elements; and
a coil, disposed on the fan frame, configured to drive the induction elements, such that the fan blades corresponding to the induction elements swing back and forth to generate a vibration sound.

23. The blower as claimed in claim 1, wherein the vibration sound generated by the fan blades has the same frequency as the eddy noise and the same amplitude as the eddy noise, and the vibration sound generated by the fan blades has an opposite phase of the eddy noise.

* * * * *